US005405029A

United States Patent [19]

Sedushak

[11] Patent Number: 5,405,029

[45] Date of Patent: Apr. 11, 1995

[54] PORTAL CRANE WITH ADDITIONAL LOAD CARRIER

[75] Inventor: Donald J. Sedushak, Brookfield, Wis.

[73] Assignee: Harnischfeger Corporation, Brookfield, Wis.

[21] Appl. No.: 147,053

[22] Filed: Nov. 3, 1993

[51] Int. Cl.[6] ..... B66C 17/06

[52] U.S. Cl. ..... 212/219; 212/220; 212/234

[58] Field of Search ..... 212/218, 219, 220, 234, 212/127, 129; 414/626, 140.3, 140.4

[56] References Cited

U.S. PATENT DOCUMENTS

| | | | |
|---|---|---|---|
| 849,920 | 4/1907 | Seaver et al. | 212/219 |
| 1,057,735 | 4/1913 | Hertz | 212/129 |
| 3,487,957 | 1/1970 | Brewer | 212/220 |
| 3,807,582 | 4/1974 | Anderson | 414/140.3 |
| 4,018,349 | 4/1977 | Hupkes | 212/219 |
| 4,106,639 | 8/1978 | Montgomery et al. | 212/219 |
| 4,293,077 | 10/1981 | Makino | 212/147 |
| 4,642,017 | 2/1987 | Fenn | 212/218 |

FOREIGN PATENT DOCUMENTS

| | | | |
|---|---|---|---|
| 257420 | 6/1988 | Germany | 212/218 |
| 360312 | 1/1973 | U.S.S.R. | 212/220 |
| 1232610 | 5/1986 | U.S.S.R. | 414/626 |

*Primary Examiner*—Michael S. Huppert
*Assistant Examiner*—Thomas J. Brahan
*Attorney, Agent, or Firm*—Michael, Best & Friedrich

[57] ABSTRACT

A crane comprising a horizontally extending frame having a longitudinal axis, the frame being supported above the ground for horizontal movement generally perpendicular to the longitudinal axis; a trolley supported on the frame for movement generally along the longitudinal axis; a mechanism for engaging and disengaging a load; a hoist mounted on the trolley for causing vertical movement of the mechanism; and a carrier connected to the frame for movement with the frame, the carrier being positioned such that the trolley, hoist and mechanism are operable to deposit a load in the carrier.

12 Claims, 4 Drawing Sheets

PORTAL CRANE WITH ADDITIONAL LOAD CARRIER

BACKGROUND OF THE INVENTION

1. Field of the Invention

The invention relates to cranes having an elongated frame movable above the ground along a line perpendicular to the frame axis, a trolley movable along the frame, and a hoist on the trolley for causing vertical movement of a load engaging mechanism. More particularly, the invention relates to portal cranes.

2. Reference to Prior Art

Portal cranes are typically employed to handle material or objects stored in an elongated area several hundred or thousand feet in length, such as a log yard, pipe yard, or other material handling area. A portal crane has an elongated frame and typically moves along the elongated area or runway on a pair of spaced, parallel rails extending perpendicular to the longitudinal axis of the frame. A trolley is supported for movement along the frame, and a hoist on the trolley is connected to a load engaging mechanism such as a grapple. The trolley, hoist and grapple are operable to engage a load of objects, such as logs, and the hoist is operable to raise the load to a vertical level above the objects stored in the area, thereby permitting the loaded crane to move along the rails and runway. After the crane reaches an appropriate unloading area, such as the log receiving area of a paper mill or the truck loading area of a pipe yard, the load is deposited. After depositing the load, the crane is again moved along the rails and runway to pick up another load for delivery to the unloading area.

SUMMARY OF THE INVENTION

The invention provides a crane of the type described above having a carrier connected to the frame for movement with the frame along the runway, thereby permitting a second load of material to be deposited in the carrier and carried along the rails and runway by movement of the frame.

More particularly, the invention provides a portal crane for handling objects such as logs in the log yard of a paper mill. The crane includes a horizontally extending frame having a longitudinal axis. Pairs of legs support the frame for horizontal movement along a runway generally perpendicular to the longitudinal axis of the frame. The legs in each pair are connected by respective sill beams and move along respective rails extending along the runway. A trolley is supported for movement on the frame, and a hoist is mounted on the trolley for causing vertical movement of a load engaging mechanism such as a grapple. The grapple is operable for engaging and disengaging a load of logs or other objects. The crane also includes a container or carrier, preferably a log bunk, connected to the frame for movement therewith. In other arrangements, the carrier can be any carrier suitably adapted for holding a material, object, or plurality of objects deposited by the load engaging mechanism. The log bunk is preferably supported by a sill beam and is positioned relative to the frame such that the grapple can deposit a load in the bunk and remove a load from the bunk.

In a first alternative embodiment of the invention, the bunk is supported in part by the sill beam and in part by a rail parallel to the rail on which the respective legs move.

In a second alternative embodiment of the invention, the bunk is supported by two sill beams.

In a third alternative embodiment of the invention, the crane has two bunks supported independently of the remainder of the crane and movable along the sill beam so that a load can be deposited in or removed from either bunk.

A portal crane having an additional bunk or carrier is capable of moving two loads of material during each trip along the runway. Because trips back and forth along the runway make up a substantial amount of the operating time of a portal crane, the additional carrier permits the crane to deliver material to the unloading area at a rate nearly twice that of a crane without an additional carrier. This is especially important in applications such as, for example, providing loads or bites of short wood to a paper mill, where a portal crane would otherwise have difficulty providing or be unable to provide logs at a rate sufficient to meet operating requirements of the mill.

Other features and advantages of the invention will become apparent to those skilled in the art upon review of the following detailed description, claims and drawings.

Figures 1, 2:
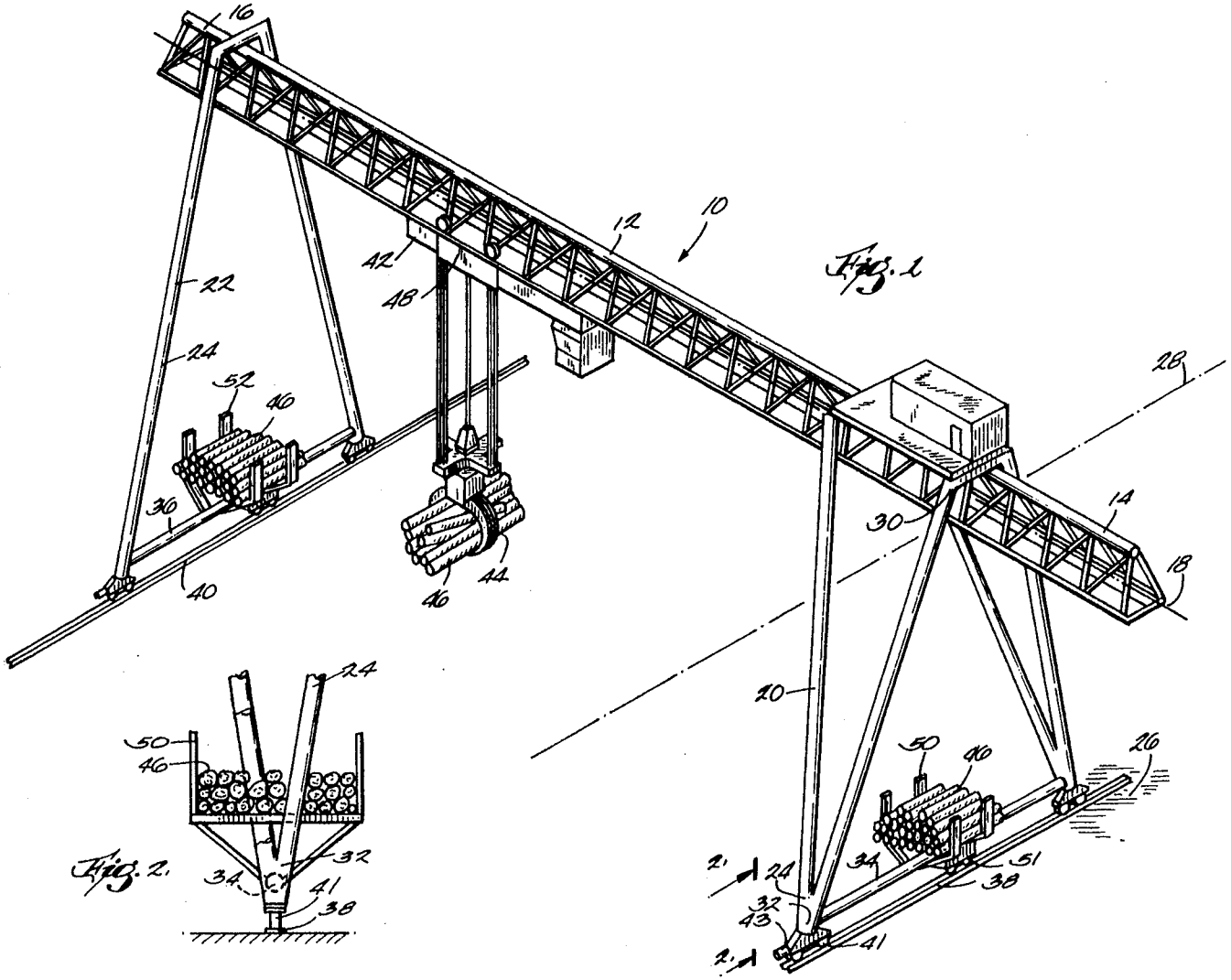
FIG. 1 is an elevated perspective view of a portal crane embodying the invention.
FIG. 2 is an enlarged side view taken generally along line 2—2 in FIG. 1.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENTS

Illustrated in FIGS. 1–2 is a crane 10 embodying the invention. The crane 10 is preferably a portal crane for handling logs in the log yard of a paper mill, and will be described in connection with that application. It should be understood, however, that the invention is applicable to portal cranes in other environments and to other types of cranes such as, for example, overhead cranes.

The crane 10 includes a horizontally extending frame 12. The frame 12 has opposed end portions 14 and 16 and a longitudinal axis 18. The crane 10 also includes first and second pairs 20 and 22 of generally vertically extending legs 24 supporting the frame 12 above the ground 26 for horizontal movement along a second axis 28 generally perpendicular to the longitudinal axis 18. Each leg 24 includes an upper end portion 30 connected to the frame 12 and a lower end portion 32 supported for movement along the ground 26 parallel to the second axis 28. The legs 24 in each pair 20 and 22 are connected by respective sill beams 34 and 36 and move along respective single lines or rails 38 and 40 parallel to the second axis 28. The legs are supported for movement along the rails 38 and 40 by wheel assemblies 41. The wheel assemblies 41 engage and ride on the respective rails 38 and 40. At least one of the wheel assemblies 41 includes a wheel drive motor 43 for driving the portal crane 10 for movement along the rails 38 and 40.

A trolley 42 is supported on the frame 12 for movement generally along the longitudinal axis 18. The crane 10 also includes a load engaging mechanism 44 for engaging and depositing a load 46 of material. Although different load engaging mechanisms 44 can be used, in the illustrated embodiment of the invention the load engaging mechanism 44 is a grapple for engaging and depositing a load 46 of logs. In other embodiment: (not shown), for example, the load engaging mechanism 44 can be a magnet, hook, or bucket. A hoist 48 is mounted on the trolley 42 for causing vertical movement of the grapple 44. The elements of the crane 10 described thus far are conventional and will not be described in greater detail. Except as described herein, the crane 10 is identical to the crane disclosed in U.S. Pat. No. 4,949,854, which is incorporated herein by reference.

The crane 10 also includes a carrier 50 connected to the frame 12 for movement with the frame 12. In the illustrated embodiment of the invention, the carrier 50 is a bunk for holding a plurality of logs. In other arrangements (not shown), the carrier 50 can be any carrier, such as, for example, a bin or magnet, suitably adapted for holding a material, object, or plurality of objects deposited by the load engaging mechanism. The bunk 50 is supported solely by the sill beam 34. The sill beam 50 is supported beneath the bunk 50 by wheels 51 which roll on the rail 38. The bunk 50 is positioned relative to the frame 12 such that the trolley 42, hoist 48, and grapple 44 are operable to deposit a load 46 in and remove a load 46 from the bunk 50. The bunk 50 can also be unloaded by a separate forklift. In other embodiments (not shown), the bunk 50 can include means for unloading itself, such as a folding side or means for dumping or tilting. Preferably, a bunk 52 identical to the bunk 50 is supported by the sill beam 36. The bunk 52 is also positioned relative to the frame 12 such that the trolley 42, hoist 48, and grapple 44 are operable to deposit a load 46 in and remove a load 46 from the bunk 52.

In operation, the empty crane 10 is moved on the rails 38 and 40 from the log receiving area of the paper mill across a log yard for several hundred or thousand feet. The trolley 42, hoist 48 and grapple 44 are operated to pick up loads or bites 46 of logs from the log yard and deposit the logs in the bunks 50 and 52. The trolley 42, hoist 48 and grapple 44 are then operated to pick up an additional bite 46 of logs which is retained by the grapple 44 and not deposited into the bunks 50 and 52. The crane 10 is then moved back along the rails 38 and 40, thereby transporting all three bites back across the log yard to the log receiving area of the mill. Upon the crane 10 reaching the log receiving area of the mill, the trolley 42, hoist 48 and grapple 44 are operated to deposit into the log receiving area of the mill the bite 46 of logs in the grapple 44. Then, the trolley 42, hoist 48 and grapple 44 are operated to remove the bites 46 of logs from the bunks 50 and 52 and deposit those bites 46 into the log receiving area of the mill. The crane 10 is then ready for another trip across the log yard for providing logs to the mill.

Figure 3:
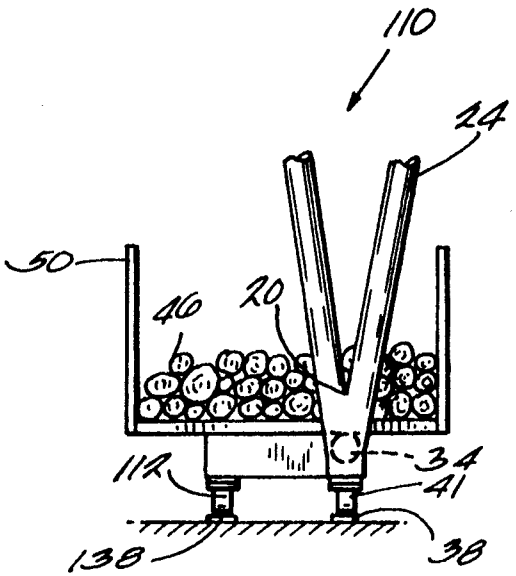
FIG. 3 is a side view similar to FIG. 2, showing a first alternative embodiment of the invention wherein the bunk is supported in part by the sill beam and in part by a rail.
Figure 5:
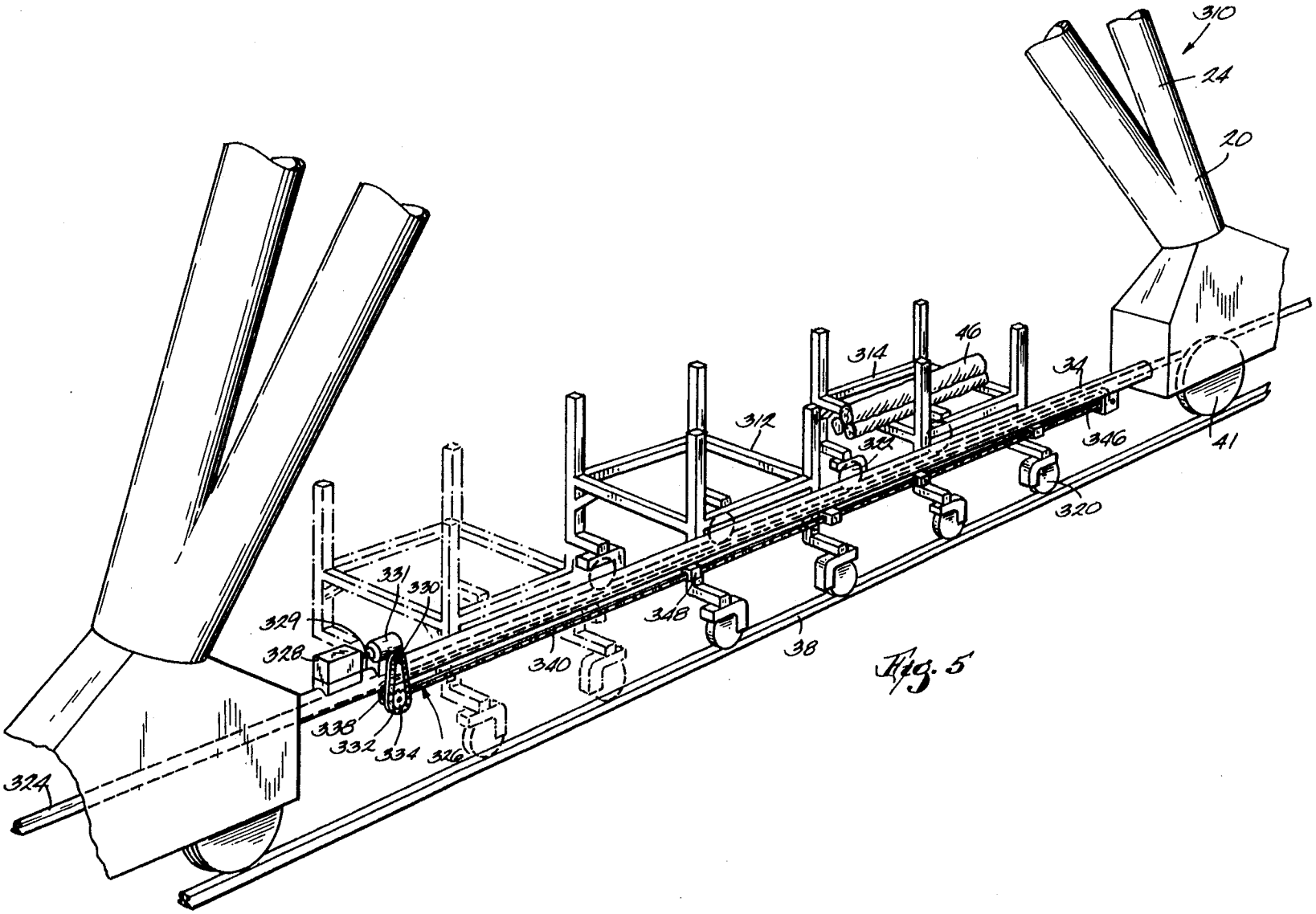
FIG. 5 is an enlarged partial perspective view of a third alternative embodiment of the invention wherein the crane includes two bunks.

A crane 110 that is a first alternative embodiment of the invention is illustrated in FIG. 3. Except as described below, the crane 110 is identical to the crane 10, and common elements have the same reference numerals. The carrier 50 of the crane 110 is supported in part by the sill beam 34 and in part by a pair of wheels 112 rolling on a second rail 138 parallel to the rail 38.

Figure 4:
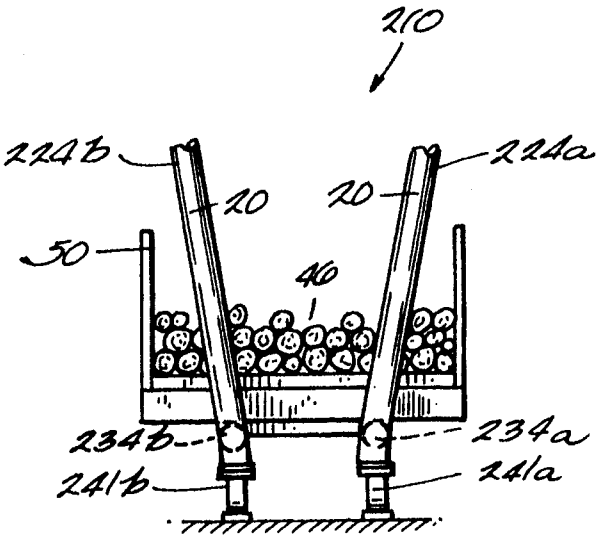
FIG. 4 is a side view similar to FIG. 3, showing a second alternative embodiment of the invention wherein the bunk is supported by a pair of sill beams.

A crane 210 that is a second alternative embodiment of the invention is illustrated in FIG. 4. Except as described below, the crane 210 is identical to the crane 10, and common elements have the same reference numerals. The legs 24 in the first pair 20 include spaced apart first and second sections **224*a* and 224*b* which are connected by respective sill beams 234*a* and 234*b*. The first and second leg sections 224*a* and 224*b* are supported by respective first and second wheel assemblies 241*a* and 241*b*. The wheel assemblies 241*a* and 241*b* move along respective rails 238*a* and 238*b*. The bunk 50 is supported in part by each of the sill beams 234*a* and 234*b***.

Figure 6:
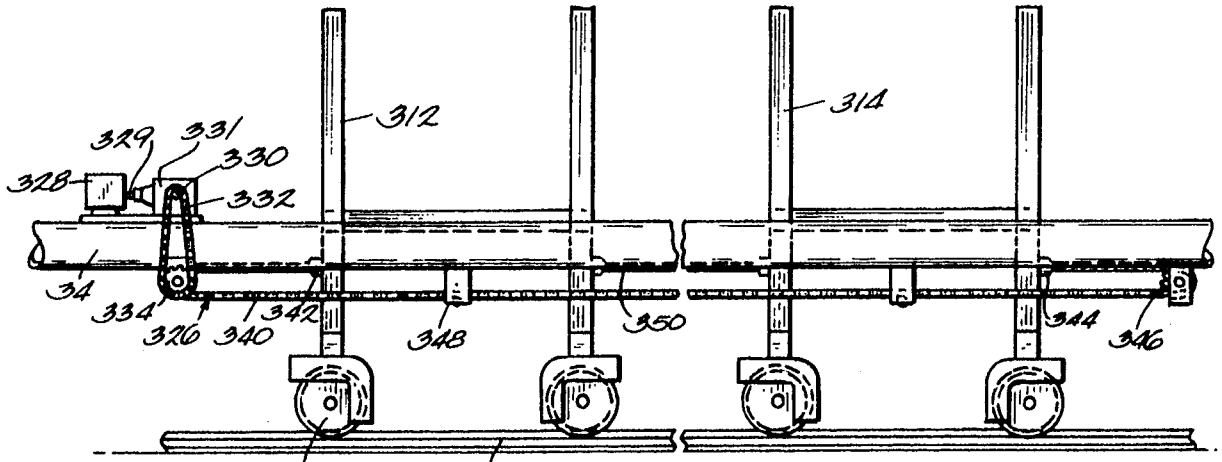
FIG. 6 is an enlarged partial end view taken generally along line 6—6 in FIG. 5.
Figure 7:
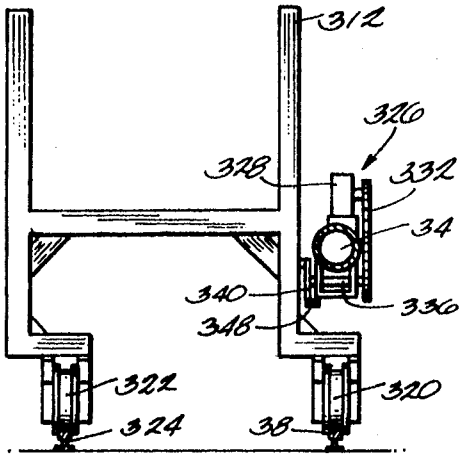
FIG. 7 is an enlarged side view taken generally along line 7—7 in FIG. 6.

A crane 310 that is a third alternative embodiment of the invention is illustrated in FIGS. 6–8. Except as described below, the crane 310 is identical to the crane 10, and common elements have the same reference numerals. The crane 310 comprises (see FIG. 7) first and second or left and right bunks 312 and 314. Each of the bunks 312 and 314 is supported independently from the remainder of the crane 310 by (see FIG. 8) first and second pairs of wheels 320 and 322. The first pair of wheels 320 rolls on the rail 38 supporting the crane legs 24, and the second pair of wheels 322 rolls on a second rail 324 parallel to the rail 38. The bunks 312 and 314 are movable together along the sill beam 34 by a bunk moving apparatus 326. The bunk moving apparatus 326 includes (see FIGS. 7 and 8) a drive motor 328 mounted on the sill beam 34. The drive motor 328 includes (see FIG. 7) an output shaft 329 connected to a primary drive sprocket 330 by a gear reducer 331. The primary drive sprocket 330 is connected by a primary drive chain 332 to a secondary drive sprocket 334. The secondary drive sprocket 334 is connected by a horizontally extending shaft 336 (see FIG. 8) to a tertiary drive sprocket 338. The tertiary drive sprocket 338 engages and drives (see FIG. 7) an elongated secondary drive chain 340 having opposite ends 342 and 344. The chain end 342 is connected to the left end of the left bunk 312, and the chain end 344 is connected to the right end of the right bunk 314. Intermediate the ends 342 and 344, the secondary drive chain 340 is trained around the tertiary drive sprocket 338 and an idler sprocket 346. Intermediate the tertiary drive sprocket 338 and the idler sprocket 346, the secondary drive chain 340 is supported by a pair of chain supports or guides 348 extending from the sill beam 34. The bunk moving apparatus 326 also includes a connecting chain 350 connected between the bunks 312 and 314. Rotation of the motor shaft 329 in one direction moves the bunks 312 and 314 to the left as seen in FIG. 7, and rotation of the shaft 329 in the opposite direction moves the bunks 312 and 314 to the right. The bunk moving apparatus 326 is selectively operable to move the bunks 312 and 314 together along the sill beam 34 between a first position shown in FIG. 6 and a second position shown by phantom lines in FIG. 6. In the first position shown in FIG. 6, the left bunk 312 is vertically underneath the frame 12 and can be loaded and unloaded by operation of the trolley 40, hoist 42 and grapple 44. In the second position shown in phantom lines in FIG. 6, the right bunk 314 is vertically underneath the frame 12 and can be loaded and unloaded by the trolley 40, hoist 42 and grapple 44.

I claim:

1. A crane comprising:

a horizontally extending frame having a longitudinal axis, said frame being supported above the ground for horizontal movement generally perpendicular to said longitudinal axis;

a plurality of generally vertically extending legs supporting said frame, said legs each including an upper end portion connected to said frame and a lower end portion supported for movement along the ground, a first pair of said legs being adapted to move along a first rail and being connected by a sill beam, a second pair of said legs being adapted to move along a second rail parallel to said first rail, a trolley supported on said frame for movement generally along said longitudinal axis;

a mechanism for engaging and disengaging a load;

a hoist mounted on said trolley for causing vertical movement of said mechanism;

a first carrier connected to said frame for movement with said frame, said first carrier being connected to said sill beam and partially supported on a third rail parallel to said first rail, and a second carrier connected to said sill beam;

said carriers being selectively movable along said sill beam such that each of said carriers can be positioned such that said trolley, said hoist and said mechanism are operable to deposit a load in each of said carriers.

2. The crane as set forth in claim 1 wherein said carriers are supported independently of the reminder of said crane.

3. The crane as set forth in claim 1 wherein said load engaging mechanism is a grapple.

4. The crane as set forth in claim 1 wherein said carrier is a bunk for holding a plurality of logs.

5. A crane comprising:

a horizontally extending frame having a longitudinal axis, said frame being supported above the ground for horizontal movement generally perpendicular to said longitudinal axis;

a plurality of generally vertically extending legs supporting said frame, said legs each including an upper end portion connected to said frame and a lower end portion supported for movement along the ground, a pair of said legs being adapted to move generally along a single line and being connected by a sill beam, a trolley supported on said frame for movement generally along said longitudinal axis;

a mechanism for engaging and disengaging a load;

a hoist mounted on said trolley for causing vertical movement of said mechanism;

a carrier connected at one end of said frame for movement with said frame, said carrier being connected to said sill beam; and a second carrier connected at the same end of said frame, said second carrier connected to said sill beam, and said carriers being selectively movable along said sill beam in a direction perpendicular to said longitudinal axis of said frame such that each of said carriers can be positioned such that said trolley, said hoist and said mechanism are operable to raise a load spaced from one of the carriers, traverse it along said frame, and deposit it in the carrier.

6. The crane as set forth in claim 5 wherein said load engaging mechanism is a grapple.

7. The crane as set forth in claim 5 wherein said carriers are bunks for holding a plurality of logs.

8. A portal crane comprising:

a horizontally extending frame having a longitudinal axis;

a plurality of generally vertically extending legs supporting said frame for horizontal movement along a second axis generally perpendicular to said longitudinal axis, said legs each including an upper end portion connected to said frame and a lower end portion supported for movement along the ground parallel to said second axis, a pair of said legs being adapted to move generally along a single line parallel to said second axis, and said pair of legs being connected by a sill beam;

a trolley supported on said frame for movement generally along said longitudinal axis;

a grapple for engaging and depositing a load of logs; a hoist mounted on said trolley for causing vertical movement of said grapple;

a first bunk for holding a plurality of logs, said first bunk being connected at one end of said frame to said sill beam, and a second bunk connected at the same end of said frame to said sill beam;

said bunks being selectively movable along said sill beam in a direction perpendicular to said longitudinal axis of said frame such that each of said bunks can be positioned such that said trolley, said hoist and said grapple are operable to raise a load spaced from one of said bunks, traverse it along said frame, and deposit it in the bunk.

9. The crane as set forth in claim 8 wherein said trolley, said hoist and said grapple are operable to remove loads from said bunks.

10. The crane as set forth in claim 8 and further comprising a plurality of rails for supporting said leg lower end portions for movement.

11. The crane as set forth in claim 10 wherein said pair of legs is supported on a first rail, another pair of said less is supported on a second rail parallel to said first rail, and said bunks are partially supported on a third rail parallel to said first rail.

12. The crane as-set forth in claim 8 wherein said bunks are supported independently of the remainder of said crane.

* * * * *